United States Patent [19]

Martin et al.

[11] 4,409,825

[45] Oct. 18, 1983

[54] DOWN HOLE STEAM QUALITY MEASUREMENT

[75] Inventors: William L. Martin, Ponca City; S. Randall Whitt, Oklahoma City, both of Okla.

[73] Assignee: Conoco Inc., Ponca City, Okla.

[21] Appl. No.: 280,536

[22] Filed: Jul. 6, 1981

[51] Int. Cl.[3] ..... E21B 47/00

[52] U.S. Cl. ..... 73/155; 166/264

[58] Field of Search ..... 73/29, 155; 166/264

[56] References Cited

U.S. PATENT DOCUMENTS

| | | |
|---|---|---|
| 898,610 | 9/1908 | Thomas . |
| 1,789,705 | 1/1931 | Hamilton . |
| 1,961,245 | 6/1934 | Powell . |
| 2,387,717 | 10/1945 | Clarkson . |
| 3,100,395 | 8/1963 | Morley . |
| 3,392,572 | 7/1968 | Brown . |
| 3,413,838 | 12/1968 | Duddy . |
| 3,430,483 | 3/1969 | Clawson et al. . |
| 3,499,488 | 3/1970 | Haynes, Jr. et al. . |
| 3,563,311 | 2/1971 | Stein . |
| 3,596,516 | 8/1971 | Haynes, Jr. et al. . |
| 3,934,469 | 1/1976 | Howard et al. . |
| 3,981,189 | 9/1976 | Howard et al. ..... 73/155 |
| 4,034,597 | 7/1977 | Fredriksson . |
| 4,063,228 | 12/1977 | Eggenberger et al. . |
| 4,092,846 | 6/1978 | Jeffery et al. . |
| 4,149,403 | 4/1979 | Muldary et al. . |
| 4,193,290 | 3/1980 | Sustek, Jr. et al. . |

FOREIGN PATENT DOCUMENTS

| | | |
|---|---|---|
| 2263754 | 7/1974 | Fed. Rep. of Germany . |
| 917714 | 2/1963 | United Kingdom . |
| 277319 | 7/1970 | U.S.S.R. . |

OTHER PUBLICATIONS

Wilson, "Steam Quality and Metering," *Journal of Canadian Petroleum Technology,* Apr./Jun. 1976, pp. 33–38.

Redford et al., "The Oil Sands of Canada-Venezuela 1977," *The Canadian Institute of Mining and Metallurgy,* CIM Special vol. 17.

Sperry-Sun, *Composite Catalog of Oil Field Equipment and Services,* 1978–1979, vol. 4, pp. 6012–6013.

*Primary Examiner*—Anthony V. Ciarlante

*Attorney, Agent, or Firm*—A. Joe Reinert

[57] ABSTRACT

A system is provided for determining quality, pressure, temperature and enthalpy of wet steam at a predetermined depth within a well through which the wet steam flows.

22 Claims, 3 Drawing Figures

DOWN HOLE STEAM QUALITY MEASUREMENT

BACKGROUND OF THE INVENTION

1. Field of the Invention

The present invention relates generally to the measurement of steam quality at a down hole location within a well through which wet steam is flowing.

2. Description of the Prior Art

The quality of wet steam is defined as the percent of total mass flow that exists in the vapor phase. When wet steam flows through a system of any type and heat is lost therefrom a certain portion of the vapor condenses to liquid thus decreasing the quality of the steam. The change in quality of the steam is therefore a direct indication of heat loss from the system.

Two particular systems which are the subject of the present disclosure, and in which heat loss from flowing wet steam is an important concern, are steam injection wells and geothermal production wells. In both of these types of wells, wet steam flows either downward or upward, respectively, through a pipe string placed in the well. Wellbore heat loss is an intrinsic inefficiency involved in each of these types of systems. For example, in a steam injection well, the quality of the wet steam decreases as the steam flows downward through the injection string, because of heat loss through the walls of the injection string. It is very desirable to be able to monitor the quality of the steam down hole so that the condition of the steam injected into the underground formation will be known.

It is also desirable to measure the pressure of the wet steam at the down hole location so that the enthalpy of the steam may be calculated. The temperature of the steam may also be determined based upon the measured pressure, under conditions of equilibrium two phase flow. Once the pressure and quality of the wet steam are known the enthalpy of the steam may be determined from standard steam tables.

The prior art includes numerous methods for determining steam quality in surface lines, boilers and power plants, steam turbines, and the like. The prior art also includes various devices for trapping a sample of steam condensate at selected depths within a wellbore by means of slick wire bottom hole sampling devices. The art further includes apparatus for measuring down hole wellbore pressures by injecting inert gas through capillary tubing connected between the surface and the down hole location to purge the tubing of any liquid and then allowing the gas to bleed down into the well to an equilibrium pressure level. The current state of the art, however, is such that no reliable and convenient method has existed heretofore for measuring steam quality at a down hole location, and particularly for measuring both steam quality and pressure at the down hole location.

SUMMARY OF THE INVENTION

The present invention provides apparatus and methods for determining the quality of wet steam at predetermined depths within a well through which wet steam flows. A tubing string is placed within the well for conducting wet steam through the well. A separating means is attached to the tubing string at a predetermined depth within the well for separating a sample of liquid water from the wet steam while preventing any substantial condensation of the wet steam in the separating means. A sample tube has a lower end communicated with the separating means and has an upper end extending out of the well for flowing a sample of the liquid phase of the wet steam from the separating means to the surface. Means are provided for measuring a concentration of dissolved solids in the sample of the liquid phase of the wet steam. This concentration is then compared to other concentration measurements in order to determine the quality of the steam at the down hole location of the separating means. In a steam injection well the comparison is made to a concentration of dissolved solids in feedwater going to the boiler which produces the wet steam (i.e., steam-water mixuture) injected into the well.

It is therefore a general object of the present invention to provide improved apparatus and methods for measuring steam quality at a down hole location within a well.

Another object of the present invention is the provision of apparatus and methods for separating a sample of liquid water from flowing wet steam at a predetermined depth in a well.

Yet another object of the present invention is the provision of apparatus and methods for performing such separation while preventing any substantial condensation of wet steam at the predetermined depth.

And another object of the present invention is the provision of apparatus and methods for flowing a sample of the liquid phase of the wet steam from the down hole location to the surface.

And another object of the present invention is the provision of apparatus and methods for measuring the quality and pressure of the wet steam at the predetermined depth within the well, so that the temperature and enthalpy of the wet steam may be determined.

And a further object of the present invention is the provision of apparatus and methods for measuring steam quality at two or more predetermined separated depths within the well so that variations in quality, pressure, temperature, enthalpy, and heat loss may be determined over a given portion of the well.

Other and further objects, features and advantages of the present invention will be readily apparent to those skilled in the art upon a reading of the following disclosure when taken in conjunction with the accompanying drawings.

DETAILED DESCRIPTION OF THE PREFERRED EMBODIMENTS

Figure 1:
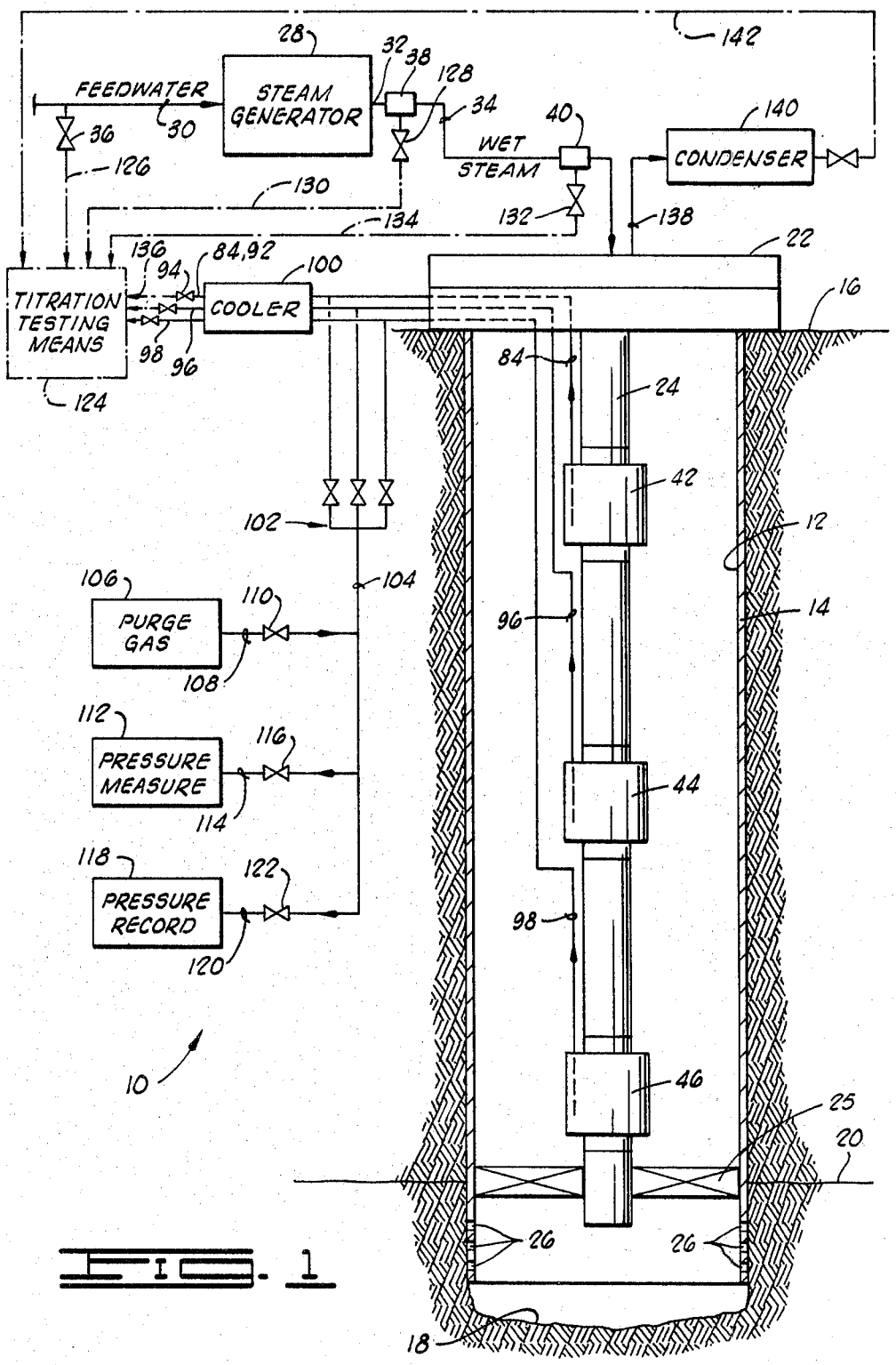
FIG. 1 is a schematic view of a system for measuring both quality and pressure of wet steam at one or more predetermined depths within a well through which the wet steam flows.

Referring now to the drawings, and particularly to FIG. 1, a system for determining quality and pressure of wet steam at a predetermined depth within a well through which the wet steam flows is shown and generally designated by the numeral 10.

A well 12 defined by casing 14 extends from a ground surface 16 downward to a hole bottom 18 and intersects a subterranean formation the upper portion of which is indicated by the interface 20.

At the upper end of well 12 is a wellhead 22 suspended downward from which is a tubing string 24. A packer 25 seals between tubing string 24 and casing 14.

This initial description is made, only by way of example, with regard to a steam injection well and the tubing string 24 may be referred to in that context as an injection string 24. The injection string 24 conducts wet steam downward through the well so that it may be injected into the subterranean formation 20 through perforations 26 in the casing 14.

A steam generator 28 generates wet steam from boiler feedwater introduced by feedwater line 30. The wet steam exits generator 28 at outlet 32 and is conveyed to wellhead 22 by an injection conduit 34.

Thus, the feed water introduced to generator 28 through conduit 30 is partially vaporized in generator 28 to form wet steam which is conducted from outlet 32 to the wellhead 22 by conduit 34 and then down into the subterranean formation 20 by injection tubing string 24.

Means are provided at several locations along this flow path to collect and withdraw a representative sample of either the feedwater or the liquid phase of the wet steam.

A valve 36 is connected to feedwater line 30 for allowing a sample of the feedwater to be withdrawn.

A separating means 38 is provided at outlet 32 of steam generator 28 for separating and collecting a representative sample of the liquid phase of the steam immediately as it exits outlet 32.

A separating and collecting means 40 is provided immediately adjacent wellhead 22 for separating and collecting a representative sample of the liquid phase of the wet steam as it is first injected into the well 12. The separating and collecting means 40 may be constructed by placing a tee in a horizontal run of the injection conduit 34 immediately adjacent well head 22 and turning the middle leg of the tee downwards so that liquid phase from the wet steam collects in the downwardly directed middle leg of the tee.

Typical prior art steam generators such as generator 28 provide the separating and collecting means 38 on their outlets and this separating means 38 is a part of the prior art. A typical such separating means 38 is constructed by placing an annular chamber around a horizontal conduit exiting the steam generator and perforating the horizontal conduit so that liquid phase from the wet steam can run into the annular chamber and collect in a lowermost portion thereof.

Attached to the injection tubing string 24 at varying predetermined depths within the well 12 are additional separating means 42, 44 and 46 for separating a sample of liquid water from the wet steam within the injection tubing string 24 at each of those predetermined depths within the well, while preventing a substantial condensation of wet steam in the separating means.

Figure 2:
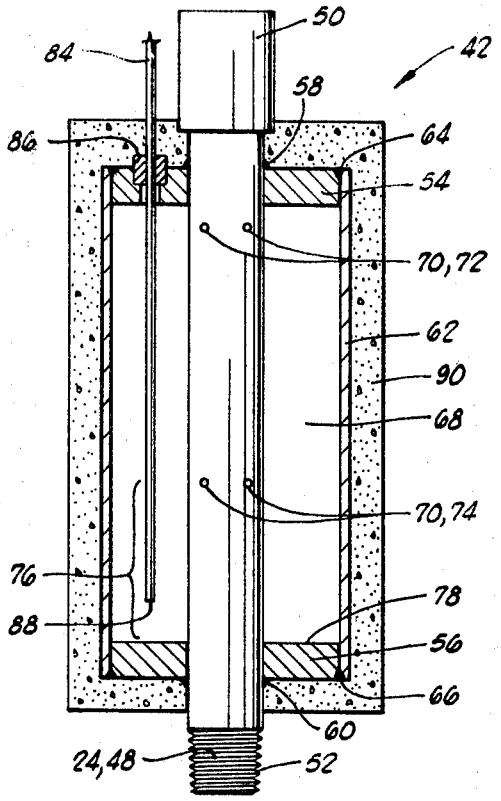
FIG. 2 is a schematic elevation partially sectioned view of a separating means for separating a sample of liquid water from the flowing wet steam.

A preferred construction of the separating means 42 is shown in FIG. 2. The separating means 42, 44 and 46 are all similarly constructed.

A length 48 of tubing, which may be considered as an integral portion of the injection tubing string 24, has a threaded collar 50 at its upper end and a threaded male end 52 at its lower end.

Upper and lower spacer rings 54 and 56 have central openings closely received about an external surface of tubing 48 and are sealingly welded thereto as shown at 58 and 60.

An outer cylindrical sleeve 62 is closely received about outer peripheral surfaces of spacer rings 54 and 56 and sealingly welded thereto as indicated at 64 and 66.

Thus, an annular chamber 68 is defined between the outer surface of tubing 48, the inner surface of sleeve 62, and the upper and lower spacer rings 54 and 56.

A communication port means 70 is disposed through a wall of tubing 48 and communicates an interior of tubing 48 with the chamber 68. The communication port means 70 includes an upper pair of perforations 72 and a lower pair of perforations 74.

The bottom of chamber 68 is closed by lower spacer ring 56 such that an annular reservoir space 76 is defined within chamber 68 between a bottom surface 78 of chamber 68 and the lower set of perforations 74, which may be described as a lowermost part of communication port means 70.

Figure 3:
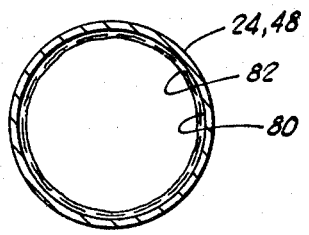
FIG. 3 is a cross section view of the tubing string illustrating the manner in which the liquid phase of the flowing wet stream flows in an annular stream adjacent the inner surface of the tubing string.

Referring now to FIG. 3, a horizontal cross sectional view is there shown of the injection tubing 24, which may also be considered as a cross sectional view of the tubing length 48. The wet steam flowing downward through the injection tubing 24 is believed to flow in a manner such that a substantial portion of the liquid phase of the wet steam is coalesced adjacent an inner surface 80 of tubing string 24 such that is flows downward in an annular stream as indicated at 82. Thus, a portion of the liquid phase of the wet steam which is flowing in annular stream 82 flows through the perforations 72 and 74 into the chamber 68 and collects in the annular reservoir space 76 at the lower end of chamber 68. Water generally does not collect in chamber 68 to any depth substantially above the lowermost perforations 74, because the water will then flow back through the perforations 74 into the interior of tubing 24.

A sample tube means 84 is sealingly disposed through upper spacer ring 54 by a swage fitting 86. A lower end 88 of sample tube means 84 opens into reservoir space 76 and is thus communicated therewith.

An insulating means 90 is disposed about sleeve 62 and spacer rings 54 and 56 to prevent any substantial heat transfer from the separating means 42, thereby preventing any substantial condensation of steam within separating means 42 or within the tubing section 48.

This insulating function is sufficiently accomplished so long as a saturated steam vapor does not condense in chamber 68 at a significant rate in comparison to the rate of accumulation and flow of the liquid phase through the annular reservoir space 76.

As is seen in FIG. 1, an upper end 92 of sample tube 84 extends out of well 12 and has a sample control valve means 94 attached thereto for selectively shutting in sample tube 84 and opening sample tube 84 to substantially atmospheric pressure.

Second and third sample tubes 96 and 98 communicate separating means 44 and 46 with the surface.

In a preferred embodiment of separating means 42 the tubing section 48 has a length of approximately 4 feet 7 inches and is constructed from $2\frac{3}{8}$ inch tubing. Upper spacer ring 54 is spaced at a distance of approximately 20 inches below the upper end of collar 50, and spacer ring 56 is placed at a distance of approximately 11 inches above the lower end of tubing section 48. Sleeve 62 is constructed from a two foot length of $4\frac{1}{2}$ inch casing. Insulation 90 is provided by wrapping sleeve 62 with several layers of fiberglass-aluminum foil laminate insulation. The sample tube 84 is constructed from $\frac{1}{4}$ inch outside diameter stainless steel tubing. The upper set of perforations 72 are ½ inch diameter drilled holes and are placed approximately 1 inch below upper spacer ring 54. The lower set of perforations 74 are also ½ inch diameter holes and are placed approximately 10 inches above lower spacer ring 56. The lower end 88 of sample tube 84 is placed approximately 1 inch above lower spacer ring 56 so that it extends well down into the reservoir space 76.

Sample tube 84 is approximately 800 feet long and has an internal diameter of ⅛ inch. The internal diameter of each sample tube should be sufficiently large that liquid flow therethrough can be accomplished with moderate pressure drops, and so that small particles will not plug the sample tube. Capillary tubes are generally not satisfactory for this because the internal diameters are too small.

Referring again to FIG. 1, the upper ends of a sample tubes 84, 96 and 98 are disposed through a cooling means 100 for cooling the liquid samples therein to a temperature low enough such that the sample will not flash when the valve such as valve 94, are opened to atmospheric pressure.

A manifold means 102 selectively connects any one of sample tubes 84, 96 and 98 to a common conduit 104.

A supply of purge gas 106, which is preferably helium or nitrogen, is provided. Purge conduit means 108 connects supply 106 to common conduit 104. A purge gas control valve means 110 is disposed in purge conduit 108 for selectively communicating or isolating the supply of purge gas 106 from the common conduit 104 and thus from the sample tubes 84, 96 and 98.

A pressure measuring means 112, which may be simply a pressure gauge, is connected to common conduit 104 by a measurement conduit means 114 which has a valve 116 disposed therein.

A pressure recording means 118, which may generally be referred to as another type of pressure measuring means, is connected to common conduit 104 by a recording conduit means 120 which has a valve 122 disposed therein.

MANNER OF OPERATION

A typical steam injection operation and the accompanying determination of down hole steam quality and pressure, with resulting determinations of enthalpy, temperature and heat loss, are performed as follows.

Boiler feedwater is directed through conduit 30 to steam generator 28 where it is partially vaporized such that wet steam exits outlet 32 of steam generator 28. The wet steam is directed through injection conduit 34 into the injection tubing string 24 at wellhead 22. The wet steam flows down injection tubing string 24 and out into the subterranean formation 20. The steam is generally allowed to flow for a substantial length of time and steam quality measurements are generally taken only after the system has reached a substantially equilibrium state.

Steam quality may be determined in many different manners known to the art, but the present invention preferably utilizes a previously known method of comparing concentrations of dissolved solids in the boiler feedwater and in the liquid phase component of the wet steam at the point of interest. These concentrations are preferably measured by means of chloride titration methods which are well known to those skilled in the art.

A simple example of steam quality measurement by comparison of concentration of dissolved solids is as follows. Designating the steam quality as S.Q., the concentration of dissolved solids in the liquid phase of the wet steam as $C_2$, and the concentration of dissolved solids in the original boiler feedwater as $C_1$, the steam quality is expressed by the following equation:

$$S.Q. = \frac{C_2 - C_1}{C_2} \times 100 = \text{mass percent vapor flowing} \quad \text{(Eqn. 1)}$$

If the concentration $C_1$ is taken as $C_1=1$, and the concentration $C_2$ then measured as $C_2=5$, then the steam quality at the point of measurement of $C_2$ is:

$$S.Q. = \frac{(5-1)}{5} \times 100 = 80\%$$

The chloride titration testing techniques are well known in the art. The process generally determines the strength of a solution, or the concentration of a substance in a solution, in terms of the smallest amount of a reagent of known concentration required to bring about a given effect in reaction with the known volume of the test solution.

The liquid sample to be tested is merely drawn off into a test tube of known volume, and is then treated with the reagent. For example, in chloride titration silver nitrate may be used to titrate the sample containing chloride ions, Silver chloride precipitates and at the end point of the titration process red silver chromate is formed. The amount of silver chloride precipitate is then determined and becomes a measure of the sodium chloride present in the sample. Using this method the sodium chloride concentration may be readily determined.

This titration testing means is schematically represented in FIG. 1 by the phantom line box 124. Using this technique the steam quality at various points between steam generator 28 and the subterranean formation 20 may be determined by comparing concentrations of dissolved solids, e.g., sodium chloride, in the liquid phase component of the wet steam to the concentration of the dissolved solids in the feedwater in conduit 30.

A sample of the feedwater from conduit 30 may be taken by opening valve 36 and may then be titration tested as represented by the line 126.

To determine the quality of steam at outlet 32 of steam generator 28 a representative sample of the liquid phase of the wet steam is separated and collected in separating means 38 and is then drawn off by means of valve 128 and is titration tested as represented by line 130. The quality of the wet steam passing through separating means 38 may then be determined by Equation 1 given above.

To determine the quality of wet steam entering wellhead 22 a sample of the liquid phase of the wet steam is separated and collected in separating means 40 and is drawn therefrom by valve 132 and titration tested as schematically represented by line 134. The quality of wet steam entering wellhead 22 may then be calculated by Equation 1 given above.

To determine the quality of steam flowing through injection tubing 24 at the depth of first separating means 42, a representative sample of the liquid phase of the wet steam is withdrawn through sample tube 84, is then cooled in cooler 100, and then withdrawn from sample tube 84 by means of valve 94 and titration tested as schematically represented by phantom line 136. The quality of the steam at the depth of separating means 42 within well 12 is then determined by Equation 1 given above.

The manner of withdrawing a representative sample of the liquid phase of the wet steam from separating means 42 through sample tube 84 is as follows.

Assuming that the pressure of the wet steam within conduit 24 at the depth of separating means 42 is great enough, liquid may be flowed from separating means 42 upward through sample tube 84 to the valve 94 merely by opening the valve 94 to atmospheric pressure and allowing the pressure differential to push the liquid sample through sample tube 84.

Preferably, a sample of the liquid phase of the wet steam at the depth of separating means 42 is continuously drawn through sample tube 84 so that the system is in a steady state condition. For example, the flow rate of wet steam being injected into the injection string 24 at wellhead 22 should be constant for a long period of time and the flow rate of sample being drawn through sample tube 84 should be constant for a long period of time such that the dissolved solids concentration in the continuous sample being withdrawn from sample tube 84 does not change with time.

It may easily be determined whether such a steady state condition has been reached by merely taking numerous periodic measurements of dissolved solids concentration in the continuous sample being drawn from sample tube 84 while maintaining the injection rate of wet steam at a constant rate.

It is important to note that the sample being withdrawn from sample tube 84 should be withdrawn at a flow rate as low as possible in order to prevent live steam from being drawn into the chamber 68 of separating means 42. This reduces the possibility of any substantial heat transfer and accompanying condensation within the separating means 42. If substantial condensation occurs within the separating means 42 then the concentration measurements of dissolved solids within the sample being withdrawn therefrom will be in error and will be lower than they should be due to dilution by the additional condensed liquid.

Quality measurements of the wet steam at the depths of separating means 44 and 46 are similarly conducted.

It is apparent that the decrease in quality of the wet steam may be measured as the wet steam flows downward through injection tubing 24 by measuring the quality of the wet steam at two predetermined depths within the well and comparing them thus giving a measure of the changing quality over a given portion of the well defined between the two predetermined depths. For example, if it is desired to know the decrease in quality of the steam, which is previously indicated is directly related to the heat loss from injection tubing 24, between the wellhead 22 and the lower end of production tubing 24 just prior to injection into subterranean formation 20, the steam quality may be measured at a substantially zero depth within the well by measuring the quality at separating means 40 immediately adjacent wellhead 22 and the quality just prior to injection into subterranean formation 20 may be measured by measuring the quality in separating means 46 which is substantially adjacent the lower end of injection tubing 24. Thus, the decrease in steam quality throughout the entire length of injection tubing 24 may be determined and the quality of the steam being injected into subterranean formation 20 can be monitored.

If the pressure of the wet steam at the depth of separating means 42 is not greater than the hydrostatic pressure of a head of water in sample tube 84, then the sample cannot be withdrawn from sample tube 84 by merely opening valve 94, since there is insufficient pressure to lift the fluid therethrough. In such a situation, a sample of the liquid phase of the wet steam at separating means 42 may be taken in either of the following manners.

One way in which to take such a sample is to purge the sample tube 84 with nitrogen and then percolate or gas lift a sample slug of the liquid phase to the surface with live steam. The valve 94 should not be fully opened and the sample should be withdrawn slowly enough that sufficient pressure is maintained within sample tube 84 to prevent the sample from flashing.

In a second low pressure sampling method, the sample tube 84 is first purged with inert gas from purge gas supply 106. Then, the valve 94 is completely opened so that the pressure within sample tube 84 approaches atmospheric pressure. This allows the hot liquid phase sample in reservoir space 76 of chamber 68 to flash into a vapor carrying liquid droplets. This vapor will then rapidly flow up the sample tube 84. The vapor must then be condensed to a completely liquid form which may be accomplished with cooling means 100, and then the liquid sample may be titrated as previously described.

Furthermore, as previously indicated, the methods and apparatus of the present invention provide a means for measuring the pressure of the wet steam at predetermined depths within the well 12. From these pressure measurements the temperature of the wet steam at those depths may be determined by the use of steam tables. From the quality measurements combined with the pressure measurements the enthalpy of the steam at these predetermined depths may also be determined by the use of steam tables. The enthalpy of the steam is a key parameter which defines the energy in the steam.

This pressure determination is made as follows. This will be described with reference to pressure determination at the depth of first separating means 42.

Inert purging gas from supply 106 is directed through conduit 108, valve 110, and manifold 102 into sample tube 84 until all liquid is forced out of sample tube 84. The sample tube 84 is shut in after the purging operation and this is accomplished merely by closing any valve such as valve 94 communicated with any low pressure space so that the purged gas is contained within sample tube 84. This may be accomplished before the purging step by merely assuring that the sample tube 84 is shut in prior to the purging step.

The purged gas in sample tube 84 is maintained shut in until the pressure thereof in excess of the pressure of the wet steam at the depth of separating means 42 bleeds off into separating means 42 such that a pressure equalibrium is reached between the purge gas in sample tube 84 and the chamber 68 of separating means 42. Then the pressure of the purged gas in sample tube 84 is measured which may be done by merely reading a pressure gauge 112 which is communicated with the sample tube 84 through conduit 114 and open valve 116. The pressure may be continuously measured by the pressure recording means 118. Since the purge gas is at pressure equalibrium with the chamber 68 which is in fluid communication with the wet steam in injection tubing 24 through the perforations 72 and 74, the pressure of the purge gas measured by pressure measuring means 112 is equal to the pressure of the wet steam at the depth of separating means 42 less the hydrostatic head of dry nitrogen between the pressure gauge 112 and chamber 68.

The pressure of the wet steam at the depths of separating means 44 or 46 may be similarly measured.

Thus, the pressure at any given depth may be measured, and as is known to those skilled in the art the temperature of the wet steam may be determined from the pressure through the use of steam tables. The measurement of pressure in conjunction with the measurement of steam quality previously described provides the necessary data for determination of enthalpy of the steam at any of these predetermined depths within the well and accordingly the heat loss from the injection tubing string may be determined. In addition, a direct measurement is provided of the flowing two-phase pressure drop.

STEAM QUALITY IN GEOTHERMAL PRODUCTION WELLS

The methods and apparatus of the present invention have been described above with relation to a steam injection well. It will be apparent however that these methods and apparatus may also be utilized to measure steam quality and to measure heat loss from the production tubing of a geothermal production well.

For example, if the well 12 is geothermal production well and the subterranean formation 20 is a source of geothermal energy such that steam is produced therefrom and then flowed into the bottom of tubing string 24 and up the tubing string 24, the produced steam is directed from wellhead 22 to a steam production line represented schematically as 138 in FIG. 1. Typically, the steam production line 138 is connected to a steam turbine or some other means for converting the steam to a more usable form of energy.

A relative indication of the quality of the steam at various depths within a geothermal well 12 as the steam rises through the tubing string 24 may be determined by titrating representative liquid phase samples taken from the various depths and comparing the concentrations of dissolved solids in those samples. Thus, a decrease in concentration of dissolved solids in the wet steam as it proceeds upward through the tubing string 24 indicates that there is a heat loss from the tubing string 24 and that the quality of the steam is deteriorating or decreasing as the steam flows upward through the tubing string 24. The relative value of concentration measurements of the liquid phase sample taken at various depths would indicate at which portions along the tubing string 24 the most significant parts of the heat loss were occurring so as for example, to indicate the location of deteriorating insulation or the like.

In order to determine in absolute terms the quality of the steam at these various depths it is necessary to take a representative sample of the wet steam produced from the top of the well including both the liquid and vapor phases and then to completely condense the wet steam to a saturated liquid. The saturated liquid sample may be titrated to determine the dissolved solids concentration therein. That number would be analogous to (and used for) the dissolved solids concentration $C_1$ in Equation 1 previously discussed for the feedwater in feedwater conduit 30.

Such a condensing means is represented schematically at 140 in FIG. 1 and the titration of the condensed sample is represented by phantom line 142.

As an alternative to collecting a totally condensed sample, a wellhead liquid sample may be taken and used in combination with a determination of liquid and vapor flow rates to calculate a zero quality solids concentration $C_1$.

Thus it is seen that the apparatus and methods of the present invention readily achieve the ends and advantages mentioned as well as those inherent therein. While certain preferred embodiments of the invention have been illustrated for the purposes of the present disclosure, numerous changes in the arrangement and the construction of parts and steps may be made by those skilled in the art, which changes are encompassed within the scope and spirit of the present invention as defined by the appended claims.

We claim:

1. A method of determining a quality of wet steam at a predetermined depth within a well through which said wet steam is flowing, said method comprising the steps of:

separating a sample of liquid water from said wet steam at said predetermined depth, while preventing any substantial condensation of said wet steam at said predetermined depth;

flowing said sample out of said well; and then measuring a concentration of dissolved solids in said sample.

2. The method of claim 1, wherein said separating step includes steps of:

communicating at said predetermined depth in said well an interior of a first tubular member through which said wet steam is flowing with a chamber, said chamber having a closed bottom and having a reservoir space defined between said closed bottom and a lowermost point of communication between said interior of said first tubular member and said chamber; and collecting said sample of liquid water in said reservoir space.

3. The method of claim 2, wherein said first tubular member is oriented such that a longitudinal axis thereof is substantially vertical and said wet steam is flowing therethrough in a manner such that a substantial portion of the liquid water in said wet steam is coalesced adjacent an inner surface of said first tubular member and is flowing through said first tubular member in an annular stream.

4. The method of claim 3, wherein:

said collecting step is further characterized as flowing a portion of said annular stream of liquid water from said first tubular member into said reservoir space.

5. The method of claim 2, wherein:

said step of flowing said sample out of said well is further characterized as flowing said sample from said reservoir space through a sample tube having a lower end opening into said reservoir space and having an upper end extending outside of said well.

6. The method of claim 5, wherein:

said flowing step is achieved by providing a steam pressure at said predetermined depth within said well in excess of a hydrostatic pressure of a column of water in said sample tube.

7. The method of claim 6, wherein:

said flowing step is performed continuously.

8. The method of claim 5 wherein said step of flowing said sample out of said well comprises:

purging said sample tube with a purge gas;

then opening said upper end of said sample tube and thereby allowing liquid water from said reservoir space to flash in said sample tube such that the flashed water flows up said sample tube and out the upper end thereof; and condensing the flashed water exiting the upper end of the sample tube before measuring the concentrati0n of dissolved solids therein.

9. The method of claim 5, said method being further characterized as a method of determining both the quality and pressure of said wet steam at said predetermined depth within said well, said method further comprising:

purging said sample tube with a purge gas;

shutting in said upper end of said sample tube;

allowing said purge gas in said sample tube to reach a pressure equalibrium with said chamber; and measuring a pressure of said purge gas in said sample tube.

10. The method of claim 1, wherein:

said step of measuring a concentration of dissolved solids in said sample is performed by titrating said sample.

11. The method of claim 1, being further characterized as a method of determining heat loss from said wet steam as said wet steam flows through a predetermined portion of said well, said method further comprising:

determining a quality of said wet steam at a predetermined second depth within said well, said predetermined portion of said well being defined between said first and second predetermined depths; and comparing the quality of said wet steam at said first and second predetermined depths to determine an amount of decrease in steam quality over said portion of said well.

12. The method of claim 11, wherein:

one of said first and second predetermined depths is a substantially zero depth adjacent a wellhead of said well, said well being a steam injection well.

13. The method of claim 1, said well being a steam injection well, further comprising prior to said step of separating:

flowing feedwater to a steam generator;

generating said wet steam in said steam generator; and injecting said wet steam into said well.

14. The method of claim 13, further comprising:

measuring a concentration of dissolved solids in said feedwater; and comparing the dissolved solids concentrations of said feedwater and said sample.

15. The method of claim 1, said well being a geothermal production well, said method further comprising:

condensing a representative portion of wet steam exiting said well;

measuring a concentration of dissolved solids in said condensed representative portion; and comparing the dissolved solids concentrations of said condensed representative portion and said sample.

16. A system for determining a quality of wet steam at a predetermined depth within a well through which said wet steam flows, comprising:

a tubing string in place within said well for conducting said wet steam through said well;

separating means, attached to said tubing at said predetermined depth within said well, for separating a sample of liquid water from said wet steam while preventing any substantial condensation of said wet steam in said separating means;

a sample tube means, having a lower end communicated with said separating means and having an upper end extending out of said well, for flowing said sample out of said well; and measuring means for receiving said sample from said sample tube means and for measuring a concentration of dissolved solids in said sample.

17. The system of claim 16 wherein:

said separating means comprises an annular chamber surrounding said tubing string;

said tubing string has communication port means disposed through a wall thereof communicating an interior of said tubing string with said annular chamber;

said annular chamber includes a closed bottom such that an annular reservoir space is defined between said closed bottom and a lowermost part of said communication port means; and said sample tube is sealingly received through a wall of said separating means and said lower end of said sample tube opens into said reservoir space.

18. The system of claim 17, further comprising:

sample control valve means, attached to said upper end of said sample tube means, for selectively shutting in said sample tube and opening said sample tube to substantially atmospheric pressure.

19. The system of claim 18, further comprising:

a supply of purge gas under pressure;

a purge conduit means communicating said supply of purge gas with said sample tube means; and a purge gas control valve means disposed in said purge conduit means.

20. The system of claim 19, further comprising:

pressure measuring means; and measurement conduit means communicating said pressure measuring means with said sample tube means.

21. The system of claim 16, wherein said well is a steam injection well.

22. The system of claim 16, wherein said well is a geothermal production well.

* * * * *